United States Patent [19]

Ekstein

[11] Patent Number: 4,853,994

[45] Date of Patent: Aug. 8, 1989

[54] PILLOW BOOK

[75] Inventor: Penny S. Ekstein, New York, N.Y.

[73] Assignee: P.S.E. Marketing, Inc., New York, N.Y.

[21] Appl. No.: 188,904

[22] Filed: May 2, 1988

[51] Int. Cl.[4] ..... A47C 20/00

[52] U.S. Cl. ..... 5/437; 5/434; 281/31; 446/147

[58] Field of Search ..... 5/434, 436, 437, 442, 5/485; 446/147, 369; 281/15 R, 18, 27, 31, 35; D6/60

[56] References Cited

U.S. PATENT DOCUMENTS

| | | | |
|---|---|---|---|
| 784,477 | 3/1905 | Dean | 281/15 R |
| 2,409,820 | 10/1946 | Zimmern | 5/437 X |
| 3,604,026 | 9/1971 | Scheips | 5/442 |
| 3,789,546 | 2/1974 | Morrison | 5/485 X |
| 4,063,369 | 12/1977 | Hart | 281/31 X |
| 4,280,241 | 7/1981 | Pfaff | 281/31 X |
| 4,488,645 | 12/1984 | Yamaguchi | 281/18 X |

*Primary Examiner*—Gary L. Smith

*Assistant Examiner*—Michael Milano

*Attorney, Agent, or Firm*—McAulay Fisher Nissen & Goldberg

[57] ABSTRACT

A pillow book construction is disclosed formed of an inscribable, foldable cushion having a pair of spaced padded portions connected by a central unpadded portion. One or more inscribable unpadded sheet-like members are connected to the central portion of the cushion between the padded portions, and are disposed for pivotal movement between said padded portions. The cushion is foldable between an open configuration in which the padded portions are juxtaposed in side-by-side relation and a closed configuration in which the padded portions are disposed in overlying relation with the sheet-like members sandwiched therebetween. The construction is such that when the cushion is in its open configuration, the padded portions form the cover leaves of a book and the unpadded sheet-like members form the pages of a book. When the cushion is in its closed configuration, the book may be used as a cushioned pillow. A strap fastening arrangement serves to releasably retain the cushion in its closed configuration.

6 Claims, 2 Drawing Sheets

THE THREE LITTLE PIGS
10
12
20
22
24
26
34
36
38
40
42
44
48
3
4

PILLOW BOOK

FIELD OF THE INVENTION

The present invention relates to cushions, and more particularly, to a cushion that can alternately be used as a pillow and as a book. cl BACKGROUND OF THE INVENTION The prior art has provided pillows that have an additional utility over and beyond the supportive function that is normally associated with a cushion. For instance, U.S. Des. Pat. No. 276,954 discloses a kit formed of padded panels to provide a bingo bag and seat pad. U.S. Pat. No. 2,409,820 discloses a padded cover for a nursing bottle in which the front and back padded sections may be unfolded and used as a pillow. U.S. Pat. No. 2,412,769 discloses a pillow having a pocket or cover to receive a person's head while sleeping. U.S. Pat. No. Re. 26,395 discloses a children's picture book formed of folded padded panels. U.S. Pat. No. 4,280,241 discloses a child's picture book having padded panels foldable at a seam, and which book also functions as a pillow-like toy. The covers of the book, as well as the leaves, are made of foam plastic or rubber covered with cloth. In construction, the covers and leaves are made from a continuous web of material which form the pockets into which is inserted the foam plastic or rubber material. U.S. Pat. No. 4,441,271 discloses a portable and foldable seat cushion having display features thereon. The cushion has pockets to receive noise makers for producing an audible sound when slapped together. U.S. Pat. No. 4,688,286 discloses a pillow construction provided with storage compartments.

In contrast to the heretofore known pillow-like toys of the prior art, the pillow book of the present 5 invention includes a foldable cushion which, in a preferred embodiment is formed by an inscribable sleeve-like member containing a pair of padded portions. One or more inscribable, unpadded sheetlike members are centrally and transversely connected to the sleeve-like member between the padded portions. The padded portions of the sleeve-like member form the front and back covers of the pillow book while the opposed portions of the sheet-like members form the leaves or pages of the book. When the cushion is in an open configuration, that is, when the padded portions are in an in-line or side-by-side relationship, the pages formed by the unpadded sheet-like members may be leafed through in the same manner as the pages of a book. When the cushion is in a closed configuration, that is, when the padded portions are folded on each other with the sheet-like members sandwiched between said padded portions, the book may be used as an ordinary cushioned pillow. As can be appreciated, the pillow book of the present invention can be marketed as a bedding item for infants or as a novelty item for young children.

Among the many advantages of the pillow book construction of the present invention, over the prior art dual functioning cushions described above, is that the padding utilized may be ordinary stuffed pillows. For instance, the construction in U.S. Pat. Nos. 4,280,241 and 4,441,271 feature rectangular webs of material that are stuffed with relatively flat foam rubber or plastic slabs. As such, the cushions provided by these patents would not be used in bedding. As will become apparent, the preferred construction of the present invention, provided by the sleeve-like member, allows ordinary stuffed pillows to be used for the padded members.

The appearance of the padded foldable cushion, and the pages provided by the unpadded sheet-like member, more closely approximate the appearance and the operation of the coverleaves and pages of an ordinary book than the prior art patents discussed above. In the "books" provided by the prior art patents, such as U.S. Pat. No. 4,280,241, the cover members and the page members are each stuffed either with foamed plastic or with rubber, and are each of the same thickness. There is no difference in appearance or operation of the outer leaves that function as a "cover", or the inner leaves that function as the "pages." The advantage of the "booklike" construction of the present invention over the book of this patent is that the pillow book of the present invention serves as a teaching tool that familiarizes the child with the function and operation of a book in the true sense of having thick cover portions and thin leaflet or page-like segments.

An additional, important advantage of the pillow book of the present invention over the prior art references is that the novel construction herein permits the number of sheet-like members to be easily varied in accordance with the subject of the book without having to appreciably change its basic design and thus, its price. For instance, if a longer subject were to be included in the book formed by U.S. Pat. No. 4,280,241, the basic design of the web would have to be changed to increase the number of padded leaves. As can be appreciated, this would entail a major change in its design and hence, the cost of the finished product as compared to construction of the present invention where the sheet-like members are unpadded.

SUMMARY OF THE INVENTION

The pillow book of the present invention includes three major components; namely, an inscribable foldable cushion, at least on inscribable, unpadded sheet-like member fabricated from foldable material, and means for centrally and transversely connecting the sheet-like member or members to an unpadded central portion of the cushion.

The cushion has a pair of opposed padded portions that are rotatably or pivotally connected to a central portion, on opposite sides thereof. The sheet-like member is operable to be rotated or pivoted about the central portion, from one of the padded portions to the other of the padded portions.

The cushion is foldable between an open configuration in which the padded portions are juxtaposed in side-by-side relation separated by the central portion, and a closed configuration in which the padded portions are disposed in overlying relation with the sheet-like member sandwiched therebetween.

When information is inscribed on the padded portion of the cushion and on the opposed portions of the sheet-like member, and the cushion is in its open configuration, the padded portions form the cover leaves of a book while the opposed portions of the sheet-like member form the pages of a book. When the cushion is in its closed configuration, the book may be used as a cushioned pillow

DESCRIPTION OF THE DRAWINGS

In the accompanying drawings

DETAILED DESCRIPTION

Figures 1, 4:
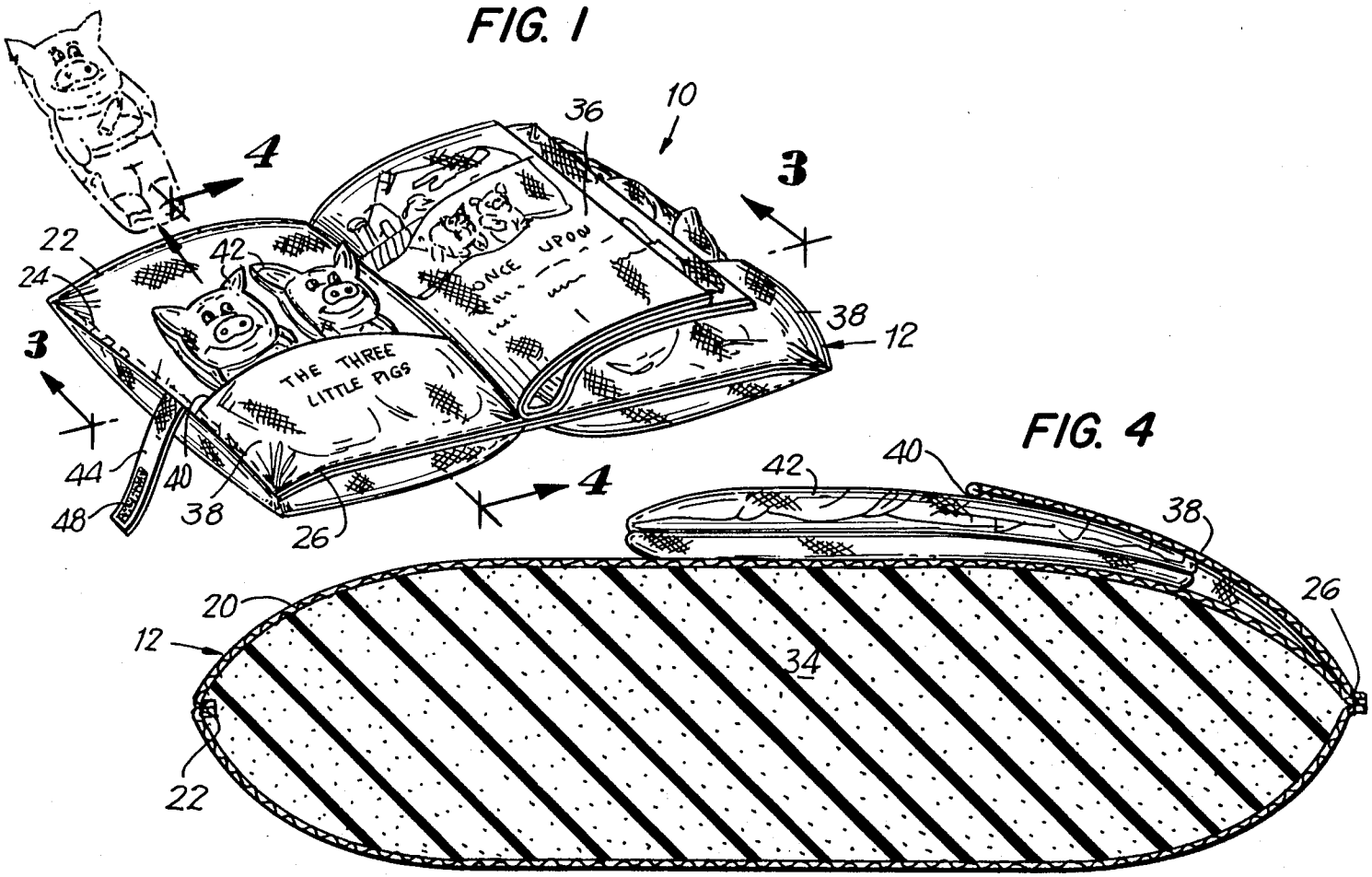
FIG. 1 is a perspective view of a pillow book of the present invention in an open configuration.
FIG. 4 is a cross-sectional view taken along lines 4—4 of FIG. 1.

Referring to the drawings, numeral 10 represents a pillow book constructed in accordance with the present invention. Pillow 10 serves to define a foldable cushion 12 having a central portion 14 and a pair of opposed portions 16 and 18 pivotally connected to central portion 14 at opposite sides thereof.

The cushion 12 is preferably fabricated of inscribable, sleeve-like linen fabric material 20. That is, material 20 is two ply, preferably rectangular in shape, with the sheets connected to one another along their peripheral edges by stitch lines 22, 24, 26 and 28. A pair of parallel, transversely oriented and laterally spaced stitch lines 30 and 32 serves to divide the fabric material into the central portion 14 and opposed portions 16, 18 of the cushion.

The opposed portions 16, 18 are disposed to receive filling or other padding material 34 therein to pad said portions and permit them to function as padded pillows. As is well known in the art, the opposed portions 16 and 18 are first filled with the padding material prior to closing of the last of the peripheral seams. However, one of such seams may be of the kind that is easily spearable, such as by utilizing buttons or snap-fasteners (not shown), to permit the filling or cushioning material to be removed for purposes of cleaning or refilling. The central portion 14 of the cushion is unpadded.

One or more inscribable, unpadded sheet-like members 36 are centrally and transversely connected to that portion of the sleeve-like material 20 which defines the central portion 14 of cushion 12. The sheet-like members 36, similar to the padded portions 16 and 18, also are fabricated of two ply linen fabric material. In the preferred construction, stitch lines 30 and 32, which are located at the juncture of the unpadded central portion 14 and padded portions 16 and 18 of cushion 12, also serve as seam lines to secure sheet-like members 36 to central portion 14. The arrangement permits the sheet-like member 36 to pivot about the central portion 14, from one of the padded portions 16 or 18 of cushion 12 to the other of such padded portions, much like turning the pages of a book in the manner hereinafter described.

Although the drawings illustrate only two sheet-like members sewn to the central portion 14 of the cushion 12, it will be appreciated that the number may be varied to include more or less sheets, as desired.

Both the sleeve-like material 20 that forms the padded portions 16 and 18, and the material that forms the sheet-like member 36, are inscribable to permit information, such as text and artwork, to be applied to the surfaces thereof, such as by printing, silk-screening, embroidering, or the like.

An additional sheet of linen fabric material 38 is secured to the sleeve-like material in the region which defines the inner surfaces of the opposed padded portions 16 and 18 of cushion 12. The sheet 38 extends upwardly from the lower edge of the padded portions and terminates at a distance approximately one-third the transverse dimension of the sleeve-like material. The same stitch lines 24, 26 and 28 used to form the peripheral edges of the padded portions 16 and 18 together with the transverse stitch lines 30 and 32, serve to secure sheet 38 in place. The top edge of sheet 38 is open thereby to define a pair of laterally spaced pockets 40 that are configured to receive one or more figurines, represented by numeral 42, that relate to the storyline of the pillow book. The figurines 42 are removable from the pockets 40 by moving them upwardly as indicated in FIG. 1.

Figure 2:
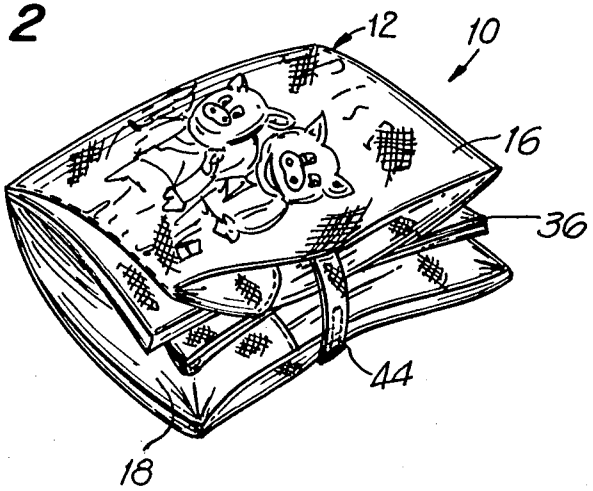
FIG. 2 is a perspective view of the pillow book of the present invention in a closed configuration.

In use, the cushion 12 is foldable to an open configuration, as illustrated in FIG. 1, where the padded portions 16 and 18 are juxtaposed in side-by-side relation separated by central portion 14. In such open configuration, the padded portions 16 and 18 form the cover leaves of a book, and the sheet-like members 36 form the pages of the book. When the cushion 12 is folded to a closed configuration, as illustrated in FIG. 2, the padded portions 16 and 18 are disposed in overlying relation with the sheet-like members 36 sandwiched therebetween. In such closed configuration, the book may be used as a cushioned pillow.

Figure 3:
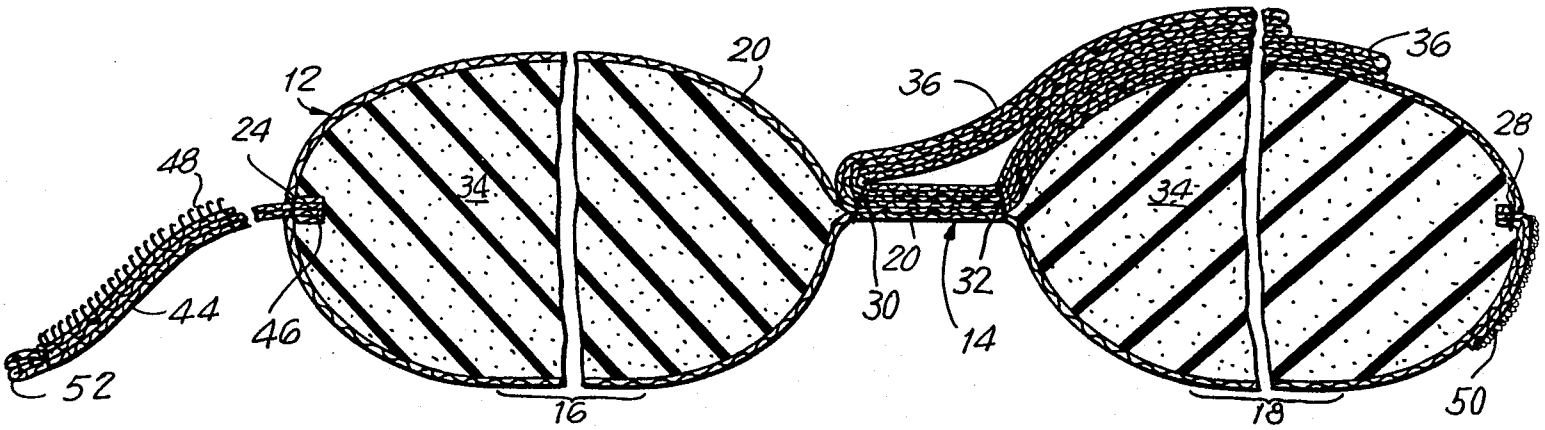
FIG. 3 is a cross-sectional view taken along lines 3—3 of FIG. 1.

An elongated strap 44 is connected, at one end 46, to an outer edge of padded portion 16 by means of seam line 24. The strap 44 is sized to extend past the corresponding outer edge of padded portion 18 when cushion 12 is in its closed configuration, as illustrated in FIG. 2. Interengaging fastening members 48 and 50, such as that identified by velcro, hook and loop, fasteners, are provided, respectively, on the free end 52 of strap and on the surface of padded members 18, adjacent seam line 28, as illustrated in FIG. 3. Thus, as is now apparent, fastening members 48 and 50 are disposed to engage when the cushion 12 is in its closed configuration to releasably retain the cushion in such configuration when the cushion is used as a pillow.

Although the disclosure provides for two lines U of stitching 30 and 32 for securing the sheet-like members 36 in place, it will be appreciated that the pillow book of the present invention could be fabricated with only a single line of stitches. Moreover, it could be possible to fabricate the sleeve-like material 20 and the sheet-like members 36 from foldable plastics, such as vinyl sheets. In such an embodiment, the lines of stitching may be replaced with lines of heat sealing.

While specific embodiments of the invention have been shown and/or described, the invention should not be considered as so limited, but may be otherwise variously embodied and practiced within the scope of the following claims.

I claim:

1. A pillow book comprising:

an inscribable foldable cushion having a central unpadded portion, and a pair of opposed padded portions pivotally connected to said central portion at opposite sides thereof;

said padded portions of said cushion being formed of sleeve-like members fabricated from foldable material and adapted to receive padding material therein;

at least one inscribable unpadded sheetlike member having a pair of opposed portions;

means for connecting said sheet-like member to said central portion of said cushion between said padded portions, said sheet-like member being disposed for pivotal movement about said central portion from one of said padded portions of said cushion to the other of said padded portions;

said cushion being foldable between an open configuration in which said padded portions are juxtaposed in side-by-side relation separated by said central portion and a closed configuration in which said padded portions are disposed in overlaying relation with said sheet-like member sandwiched therebetween;

at least one of said sleeve-like members formed having an outer pocket adapted to receive at least one figurine; and interengaging means connected to said padded portions of said cushion for releasably retaining said cushion in its closed configuration;

whereby, when information is inscribed on said padded portions of said cushions and on said opposed portions of said sheet-like member, and said cushion is in its open configuration, said padded portions form the cover leaves of a book and said opposed portions of said sheet-like member form the pages of a book, and when said cushion is in its closed configuration, said book may be used as a cushioned pillow.

2. The pillow book of claim 1, wherein said connecting means comprises a pair of parallel, spaced line of stitches that are transversely and centrally sewn through said sheet-like member and said central unpadded portion of said cushion.

3. The pillow book of claim 1, wherein said interengaging means comprises an elongated strap connected, at one end, to an edge of one of said padded portions of said cushion, said strap being sized to permit the free end thereof to extend past the corresponding edge of said other padded portion when said cushion is in its closed configuration, and interengaging fastening members on said free end of said strap and on said other padded portion of said cushion.

4. A pillow book comprising:

a plurality of leaves, the first and last of said leaves constituting cover leaves of the book;

said cover leaves being padded to form padded pillows;

an unpadded central portion connected to inboard edges of said padded cover leaves;

said leaves between said padded pillow cover leaves being unpadded sheet-like leaves connected to said central portion along an edge of each of said unpadded leaves;

said cover leaves being the sole padded leaves of the pillow book;

said pillow book being foldable between an open state in which said padded cover leaves are deployed in side-by-side relation separated by said central portion and a closed state in which said padded cover leaves are disposed in overlying relation with said sheet-like leaves sandwiched therebetween.

5. The pillow book of claim 4, wherein at least one of said cover leaves has a pocket adapted to receive at least one figurine.

6. The pillow book of claim 4, further comprising interengaging means connected to said cover leaves for releasably retaining said pillow book in its closed state.

* * * * *